US008961105B2

(12) United States Patent
Kogame

(10) Patent No.: US 8,961,105 B2
(45) Date of Patent: Feb. 24, 2015

(54) VACUUM PUMP

(75) Inventor: Masahito Kogame, Kyoto (JP)

(73) Assignee: Shimadzu Corporation, Kyoto-shi (JP)

( * ) Notice: Subject to any disclaimer, the term of this patent is extended or adjusted under 35 U.S.C. 154(b) by 462 days.

(21) Appl. No.: 13/274,463

(22) Filed: Oct. 17, 2011

(65) Prior Publication Data

US 2012/0034066 A1 Feb. 9, 2012

(51) Int. Cl.

*F04D 5/00* (2006.01)
*F04D 19/04* (2006.01)
*F04D 25/06* (2006.01)

(52) U.S. Cl.

CPC ..... *F04D 19/042* (2013.01); *F04D 25/0693* (2013.01); *F04D 19/04* (2013.01)
USPC ..... 415/55.1; 417/423.4; 415/213.1

(58) Field of Classification Search

CPC ..... F04D 19/04; F04D 19/042
USPC ..... 415/55.1, 55.5, 55.6, 213.1, 214.1, 220; 417/423.14, 423.4
See application file for complete search history.

(56) References Cited

U.S. PATENT DOCUMENTS

| | | | | |
|---|---|---|---|---|
| 5,971,725 | A * | 10/1999 | de Simon et al. | 417/423.8 |
| 2003/0170132 | A1* | 9/2003 | Englander et al. | 417/423.4 |
| 2007/0237650 | A1 | 10/2007 | Birkenstock et al. | |
| 2010/0303650 | A1 | 12/2010 | Englaender | |
| 2013/0189089 | A1* | 7/2013 | Schroder et al. | 415/182.1 |

FOREIGN PATENT DOCUMENTS

| | | | | |
|---|---|---|---|---|
| JP | 5-989 | U | 1/1993 | |
| JP | 2005-291040 | A | 10/2005 | |
| JP | 2006-90251 | A | 4/2006 | |
| JP | 2006090251 | A * | 4/2006 | F04D 19/04 |
| JP | 2007-278278 | A | 10/2007 | |
| JP | 3138105 | U | 10/2007 | |
| JP | 2010-48169 | A | 3/2010 | |
| JP | 2010048169 | A * | 3/2010 | F04D 19/04 |
| JP | 2010-236469 | A | 10/2010 | |
| JP | 2010-537122 | A | 12/2010 | |
| WO | 2011/111209 | A1 | 9/2011 | |

* cited by examiner

*Primary Examiner* — Dwayne J White
*Assistant Examiner* — Jason Fountain
(74) *Attorney, Agent, or Firm* — Westerman, Hattori, Daniels & Adrian, LLP

(57) ABSTRACT

A vacuum pump includes: a pump main body; a control unit which drives and controls the pump main body; a connector device including a first connector member on the pump main body side and a second connector member on the control unit side, at least one of power and a control signal being input and output between the pump main body and the control unit; and a connector attachment member attached to the pump main body coaxially with the pump shaft center between the pump main body and the control unit, the first connector member being attached to the connector attachment member. The connector attachment member is attached to the pump main body at one of a first phase of attachment and a second phase of attachment depending on a phase of attachment of the pump main body and the control unit.

6 Claims, 11 Drawing Sheets

VACUUM PUMP

INCORPORATION BY REFERENCE

The disclosure of the following application is herein incorporated by reference: Japanese Patent Application No. 2010-154756 filed Jul. 7, 2010.

BACKGROUND OF THE INVENTION

1. Field of the Invention

The present invention relates to an integrated type vacuum pump that includes a pump unit and a power source unit integrated with each other.

2. Description of Related Art

A vacuum pump such as a turbomolecular pump or a molecular drag pump is provided with a discharge port on the side surface of the casing of the pump main body. The side surface of the casing of the pump main body is also provided with a control power source connection port (connector) with which the vacuum pump is connected to the control power source (power source unit) (see Japanese Utility Model Registration No. 3138105).

SUMMARY OF THE INVENTION

However, the vacuum pump disclosed in Japanese Utility Model Registration No. 3138105 must be newly provided with a connection port for connecting the control power source at a different position from that of the existing one in order to change the phase of attachment (angular position of attachment) of the control power source to the main body of the pump (pump main body) with respect to the axis of the pump. Therefore, it has been difficult to change the phase of attachment of the control power source to the pump main body.

According to the first aspect of the present invention, a vacuum pump comprises: a pump main body having a rotor supported by magnetic bearings; a control unit attached to the pump main body coaxially with a pump shaft center of the pump main body, which drives and controls the pump main body; a connector device including a first connector member on the pump main body side and a second connector member on the control unit side, the first and second connector members being detachably attached to each other, at least one of power and a control signal being input and output between the pump main body and the control unit when the first connector member and the second connector member are connected to each other; and a connector attachment member attached to the pump main body coaxially with the pump shaft center between the pump main body and the control unit, the first connector member being attached to the connector attachment member. The connector attachment member is attached to the pump main body at one of a first phase of attachment and a second phase of attachment differing from the first phase of attachment depending on a phase of attachment of the pump main body and the control unit.

According to the second aspect of the present invention, a vacuum pump according to the first aspect, it is preferred that the first connector member is attached at a position eccentric from the pump shaft center.

According to the third aspect of the present invention, a vacuum pump according to the first aspect, it is preferred that the pump main body is provided with an opening through which the rotor is introduced for being attached to the pump main body, the opening being provided on a surface of the pump main body on which the connector attachment member is provided, and the connector attachment member is attached to the pump main body so as to shut the opening.

According to the fourth aspect of the present invention, a vacuum pump according to the second aspect, it is preferred that the pump main body is provided with an opening through which the rotor is introduced for being attached to the pump main body, the opening being provided on a surface of the pump main body on which the connector attachment member is provided, and the connector attachment member is attached to the pump main body so as to shut the opening.

According to the fifth aspect of the present invention, a vacuum pump according to the third aspect, it is preferred that the connector attachment member is a shutter flange-like member that shuts the opening.

DESCRIPTION OF PREFERRED EMBODIMENTS

Referring to the attached drawings, a turbomolecular pump device 1, which is an embodiment of the vacuum pump according to the present invention, is explained. In the case of the turbomolecular device 1 provided with a motor and a rotor, the motor drives and rotates the rotor provided with blades. High speed rotation of the rotary blades with respect to the stationary blades causes molecules of a gas to be discharged. The turbomolecular pump device 1 having such a construction is used as connected to various vacuum treating devices.

Figure 1:
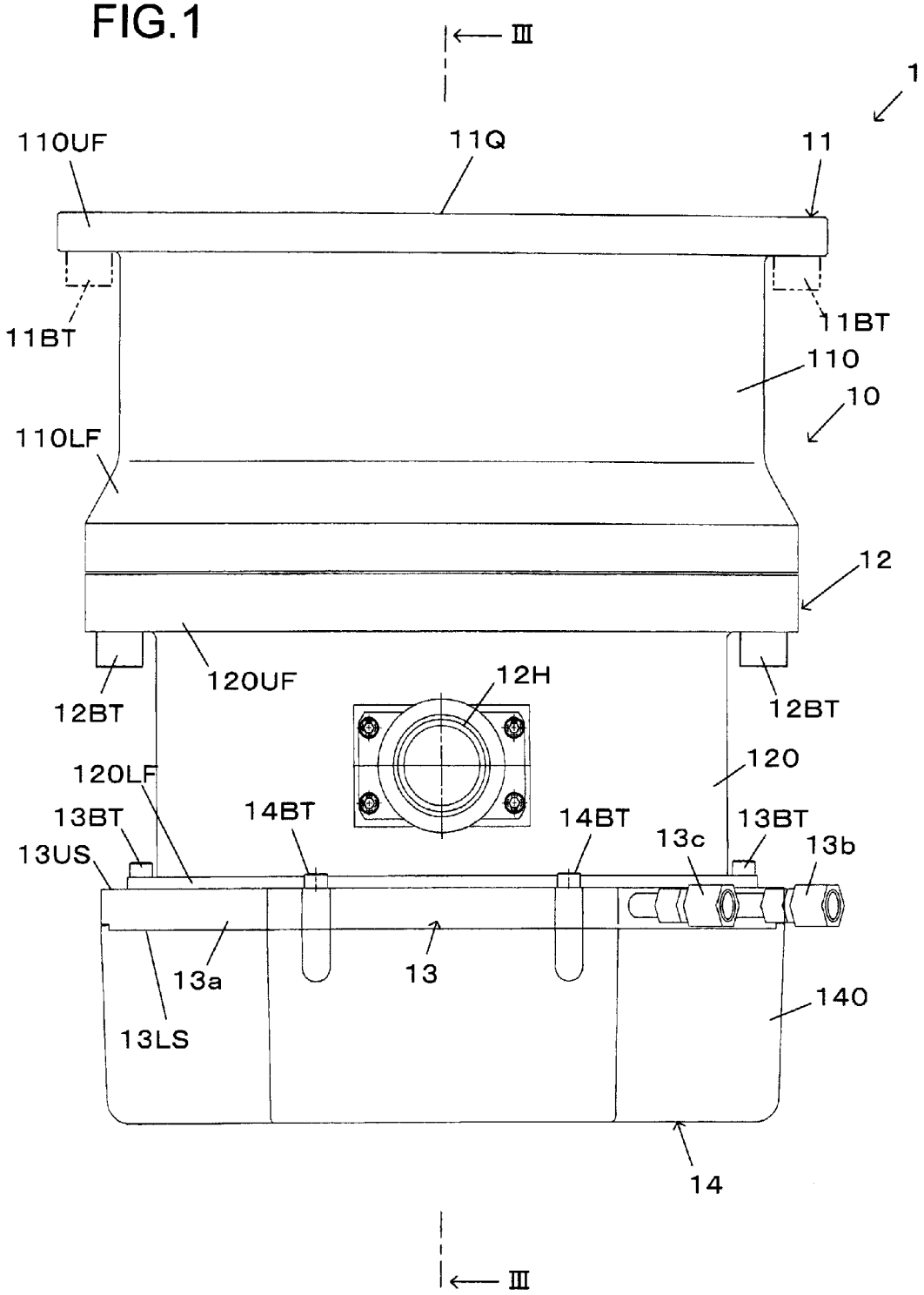
FIG. 1 presents a full view of a turbomolecular pump apparatus.

FIG. 1 shows the appearance of the turbomolecular pump device 1 according to one embodiment of the present invention. The turbomolecular pump device 1 includes a pump main body 11 that performs evacuation, a cooling device 13, and a power source device (control unit) 14 that drives and controls the pump main body 11. Details of the pump main body 11 will be described later.

Figure 2A:
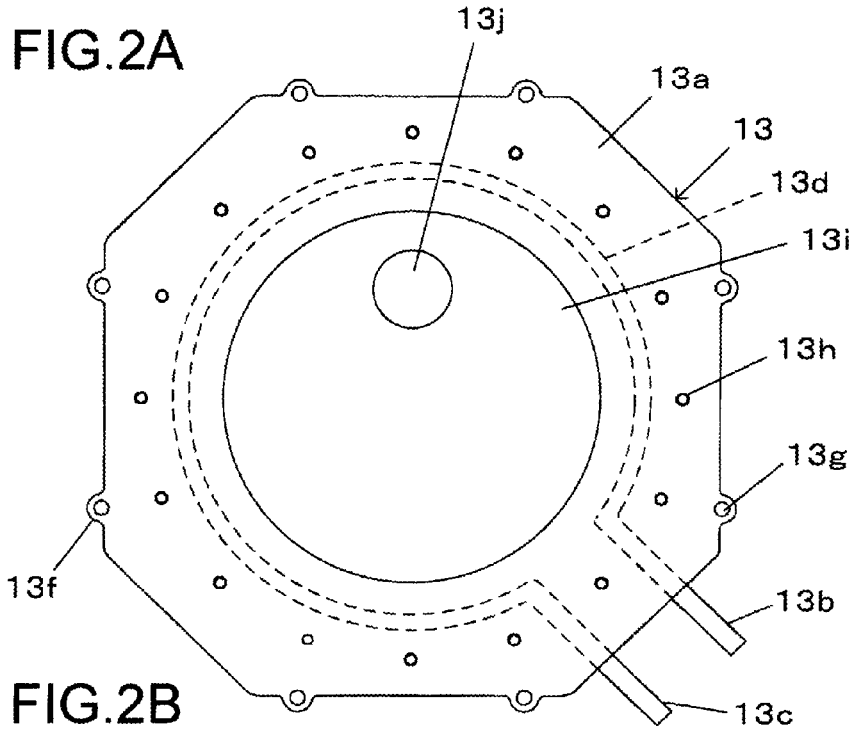
FIG. 2A presents a plan view of the water-cooled jacket.

The cooling device 13 is placed between the pump main body 11 and the power source device 14 and cools heat generating members in the power source device 14, in particular electronic components of the motor drive circuit in the main. As shown in FIG. 2A, the cooling device 13 includes a jacket main body 13*a* that is formed of a cooling water channel 13*d* in the jacket main body 13*a* as well as a cooling water inlet 13*b* and a cooling water outlet 13*c* for circulating the cooling water from a pump (not shown) in the cooling water channel.

The pump main body 11 is provided with a casing 110 and a base 12 (casing 120) that is to be attached below the casing 110. The casing 110 is provided with connection flanges 110UF and 110LF in upper and lower regions of FIG. 1. The casing 120 is provided with connection flanges 120UF and 120LF in upper and lower regions of FIG. 1. The casings 110 and 120 are called pump casings. The upper connection flange 110UF of the casing 110 is connected to the discharge port of the vacuum processing device (not shown) with bolts 11BT. The lower connection flange 110LF of the casing 110 is connected to the upper connection flange 120UF of the casing 120 with bolts 12BT. The lower connection flange 120LF of the casing 120 is placed on an upper surface 13US of the cooling device 13. The cooling device 13 is fastened to a lower surface of the casing 120 with bolts 13BT. The lower surface of the cooling device 13 abuts an upper end of a chassis (made of metal) 140 of the power source device 14. The chassis 140 is fastened to the cooling device 13 with bolts 14BT.

Figure 2B:
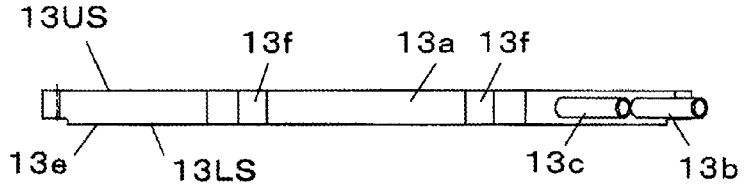
FIG. 2B presents a front view of the water-cooled jacket.
Figure 2C:
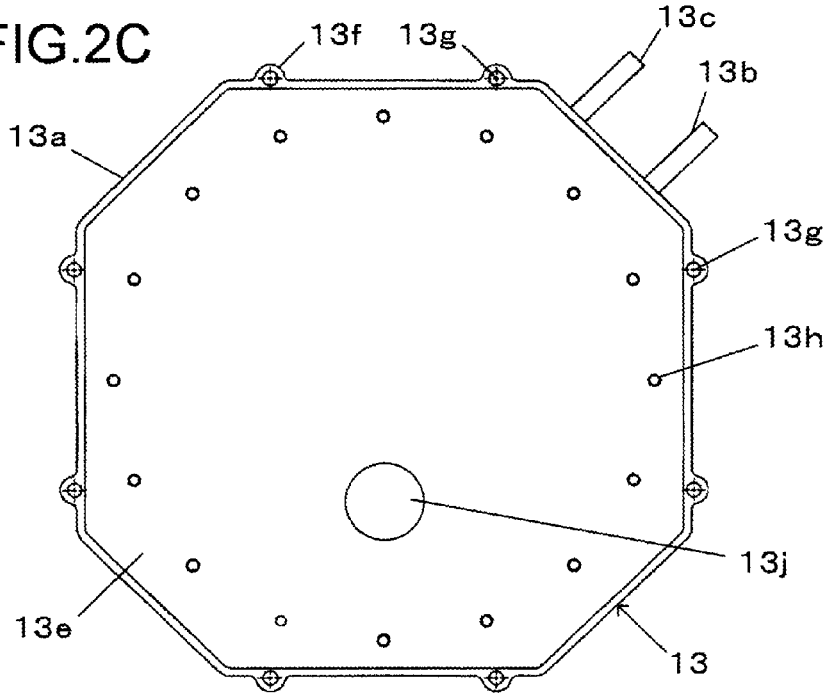
FIG. 2C presents a bottom view of the water-cooled jacket.

As shown in FIGS. 2A and 2C, the jacket main body 13*a* is in the form of a flat plate having a substantially octagonal shape, which is formed of a salient 13*e* having a substantially octagonal shape in a planar figure on the bottom surface. As shown in FIGS. 2A and 2B, in the center of the upper surface 13US of the jacket main body 13*a* is provided a substantially circular depression 13*i* for preventing interferences with a mechanical section shutter plate 122 that is described later. The depression 13*i* is provided at a position eccentric from a central position thereof with an opening 13*j* through which a connector member 132 and each wire 145 are inserted. Details of the connector member 132 and the wires 145 are described later. As shown in FIGS. 2A, 2B and 2C, a protrusion 13*f* is formed around the periphery of the jacket main body 13*a* at every predetermined angle with respect to the axis of the jacket main body 13*a*. Each protrusion 13*f* is formed by boring of a hole 13*g* for fastening the power source device chassis 140.

As shown in FIG. 2C, the salient 13*e* is formed of a plurality of screw holes 13*h* on the circumference of a circle centered on a rotation axis of the pump (pump shaft center). As shown in FIG. 1, the upper surface 13US of the jacket is abutted on the lower connection flange 120LF of the casing 120 for the base 12 and bolts 13BT are installed in the screw holes 13*h* to fasten the jacket main body 13*a* with the casing 120. The power source device 14 is fastened with the jacket main body 13*a* by abutting the upper end of the power source device chassis 140 against a rear surface 13LS of the jacket main body 13*a* and installing the bolts 14BT in the screw holes in the power source device chassis 140 (see FIG. 8).

Figure 3:
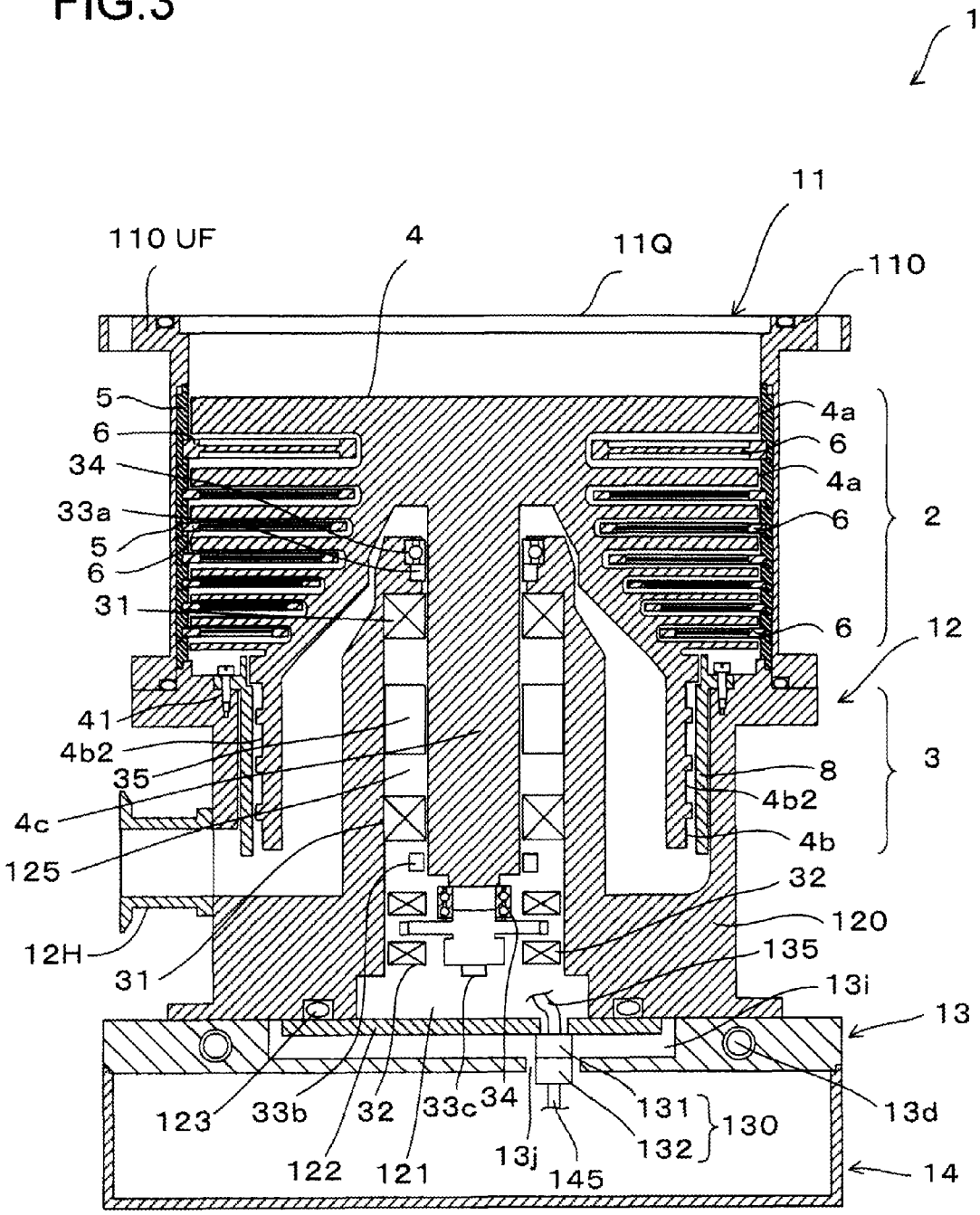
FIG. 3 presents a cross-sectional view of the turbomolecular pump apparatus shown in FIG. 1 taken in the direction along the line III-III.

FIG. 3 presents an arrow view cross-section of the turbomolecular pump device 1 shown in FIG. 1 taken along the line III-III. In FIG. 3, depiction of bolts 124 that are described later and circuit boards placed inside the power source device 14 is omitted. A rotor (rotating body) 4 is rotatably arranged inside the pump casing. The rotor 4 includes a rotation shaft 4*c* positioned in the center of the pump casing and a plurality of rotor blades 4*a* disposed in a plurality of stages around the rotation shaft 4*c* in the direction of the axis of the rotation shaft (in the vertical direction in the figure).

The turbomolecular pump device 1 is a complex type turbomolecular pump, which has a blade discharge section 2 in an internal space of the casing 110 and a thread groove discharge section 3 in an internal space of the casing 120. The blade discharge section 2 includes a plurality of stages of rotor blades 4*a* and a plurality of stages of stator blades 6 and the thread grooves discharge section 3 includes a rotor cylinder 4*b* and threaded stator 8.

The rotor blades 4*a* and the stator blades 6 are disposed alternately in the axial direction of the pump. A plurality of annular spacers 5 is provided on an inner surface of the casing 110. Each stator blade 6 is sandwiched and held by two spacers 5 above and below it at its outer periphery. The rotor 4 has the rotor cylinder section 4*b* that is integral to the rotor 4 and placed in the casing 120. The outer periphery of the rotor cylinder section 4*b* is formed of thread grooves 4*b*2. On the outer circumference of the thread grooves 4*b*2 is arranged the cylindrical threaded stator 8. The threaded stator 8 is fixed to the casing 120 with bolts 41.

The rotor 4, which is formed of the plurality of stages of rotor blades 4*a* and the rotor cylinder section 4*b*, is contactlessly supported by radial magnetic bearings 31 and thrust magnetic bearings 32 provided in the casing 120. The rotor 4 is driven by the motor 35 to rotate, with the rotation shaft 4*c* being contactlessly supported by the magnetic bearings 31 and 32. The position of magnetic levitation of the rotation shaft 4*c* of the rotor 4 is detected by gap sensors 33*a*, 33*b* and 33*c*. A mechanical protective bearing 34 supports the rotation shaft 4*c* of the rotor 4 in a state where the rotation shaft 4*c* is not levitated by the magnetic action of the magnetic bearings 31 and 32.

The casing 120 has a space 125 for attaching mechanical sections such as the rotor 4 and the motor 35. On the lower surface of the casing 120 is provided with an opening 121 that continues to the space 125 for introducing the mechanical sections for their attachment. When the turbomolecular pump device 1 is in operation, the space 125 is evacuated. Therefore, the opening 121 is shut by a mechanical section shutter plate (connector attachment member) 122. The mechanical section shutter plate 122 is a shutter flange-like member in the form of a disk, to which a connector member 131 of a connector device 130 is attached. The connector device 130 is described in detail later. The mechanical section shutter plate 122 is described in detail later.

When the rotor is driven and rotated by the motor 35, molecules of gas in the vacuum processing device (not shown) flow in into the vacuum pump 1 through a gas intake port 11Q. The molecules of gas flown in through the gas intake port 11Q are hit away downstream in the blade discharge section 2. Though not shown, the rotor blades 4*a* and the stator blades 6 have opposite inclination directions and angles of their inclination are varied such that the molecules of gas will sparingly flow backward from a preceding stage, which is a higher vacuum side, to a subsequent stage, which is a downstream side. The molecules of gas are compressed in the blade discharge section 2 and transported to the thread groove discharge section 3 in the lower part in the figure.

In the thread groove section 3, high speed rotation of the rotor cylinder section 4*b* with respect to the threaded stator 8 generates viscous flow of the molecules of gas. This activates the discharge function of the vacuum pump device 1 due to the viscous flow, so that the gas transported from the blade evacuation section 2 to the thread groove discharge section 3 is further transported toward a discharge port 12H while the gas is being compressed to achieve evacuation. According to the present embodiment, the thread groove discharge section 3 having a thread groove structure is used. However, a section that exhibits the discharge function due to viscous flow, inclusive of other structures than the thread groove structure, may be sometimes referred to as a drag pump section.

Figure 4A:
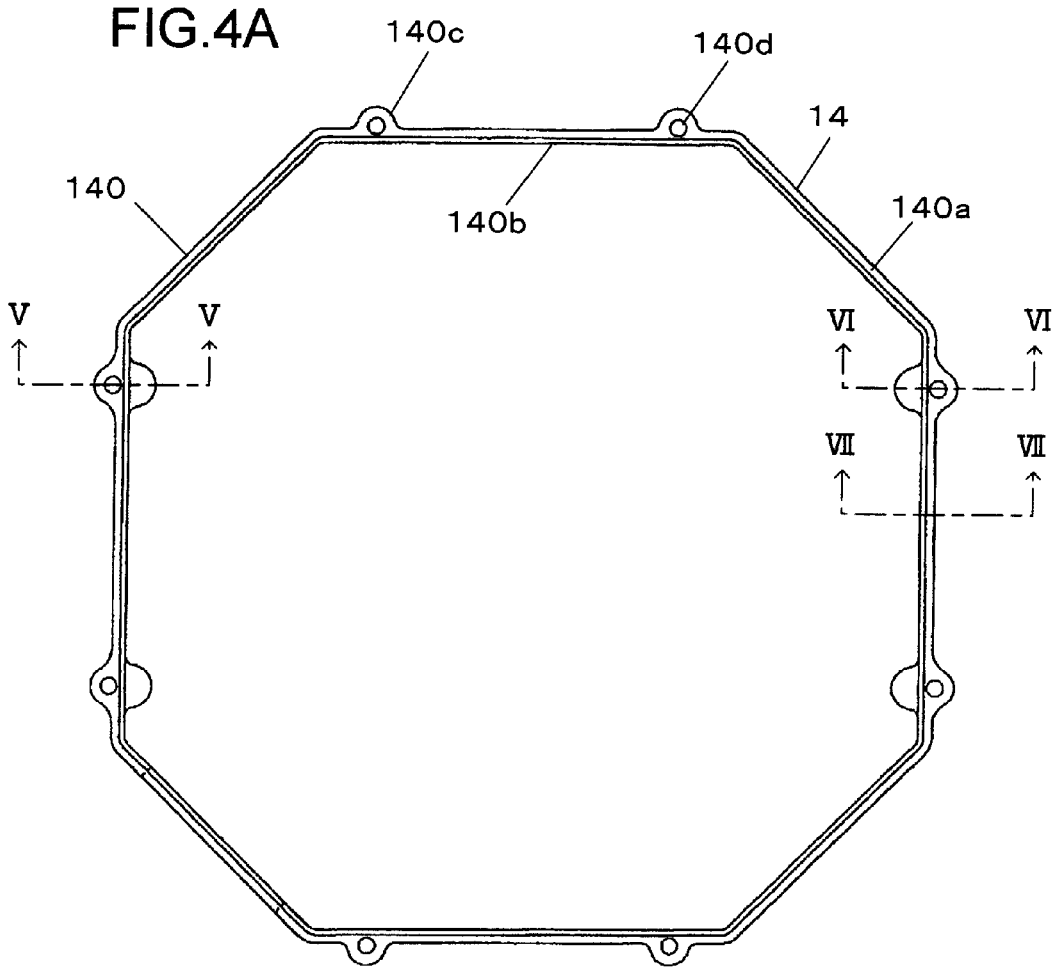
FIG. 4A presents a plan view of the power source device chassis.
Figure 4B:
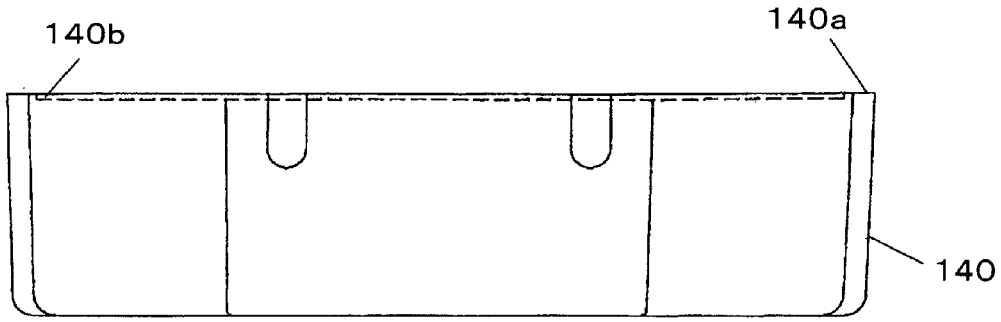
FIG. 4B presents a front view of the power source device chassis.
Figure 5:
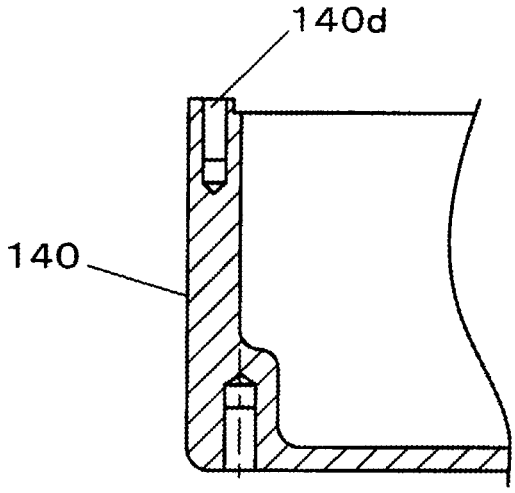
FIG. 5 presents a cross-section of the power source device chassis taken along the line V-V shown in FIG. 4A.
Figure 6:
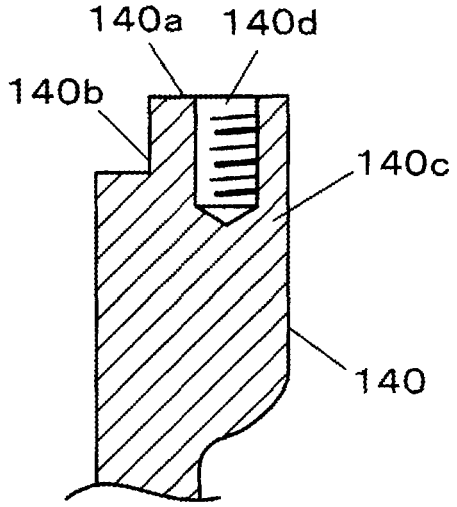
FIG. 6 presents a cross-section of the power source chassis taken along the line VI-VI shown in FIG. 4A.
Figure 7:
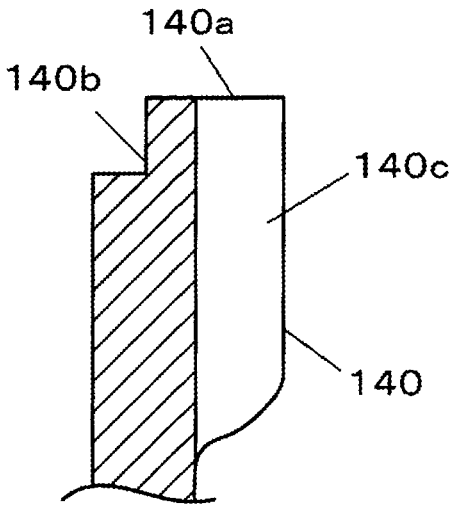
FIG. 7 is a cross-section of the power source device chassis taken along the line VII-VII shown in FIG. 4A.
Figure 8:
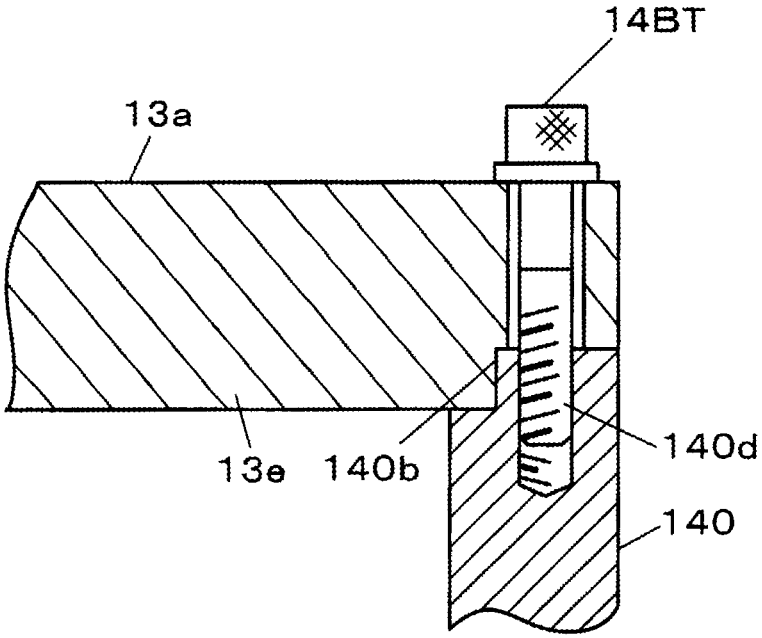
FIG. 8 presents a diagram illustrating a structure of engagement of the jacket main body with the power source device chassis.

Referring to FIGS. 4A and 4B, the power source device chassis 140 is explained. As shown in FIGS. 4A and 4B, the power source device chassis 140 is formed to be a substantially octagonal cylinder that has a lid and a bottom, with its open end 140*a* being provided with a substantially octagonal recess 140*b* along the entire circumference thereof as shown in an enlarged view in FIGS. 6 and 7. On the outer periphery of the open end 140*a* is formed a projection 140*c* at every predetermined angle. Each projection 140*c* is provided with a screw hole 140*d* for fastening the power source device chassis 140 with the jacket main body 13*a*. In the octagonal recess 140*b* is fitted the salient 13*e* of the jacket main body 13*a* as shown in FIG. 8. That is, the octagonal peripheral edge of the salient 13*e* of the cooling device 13 is fitted in the recess 140*b* that has the same octagonal configuration as that of the salient 13*e*.

Figure 9:
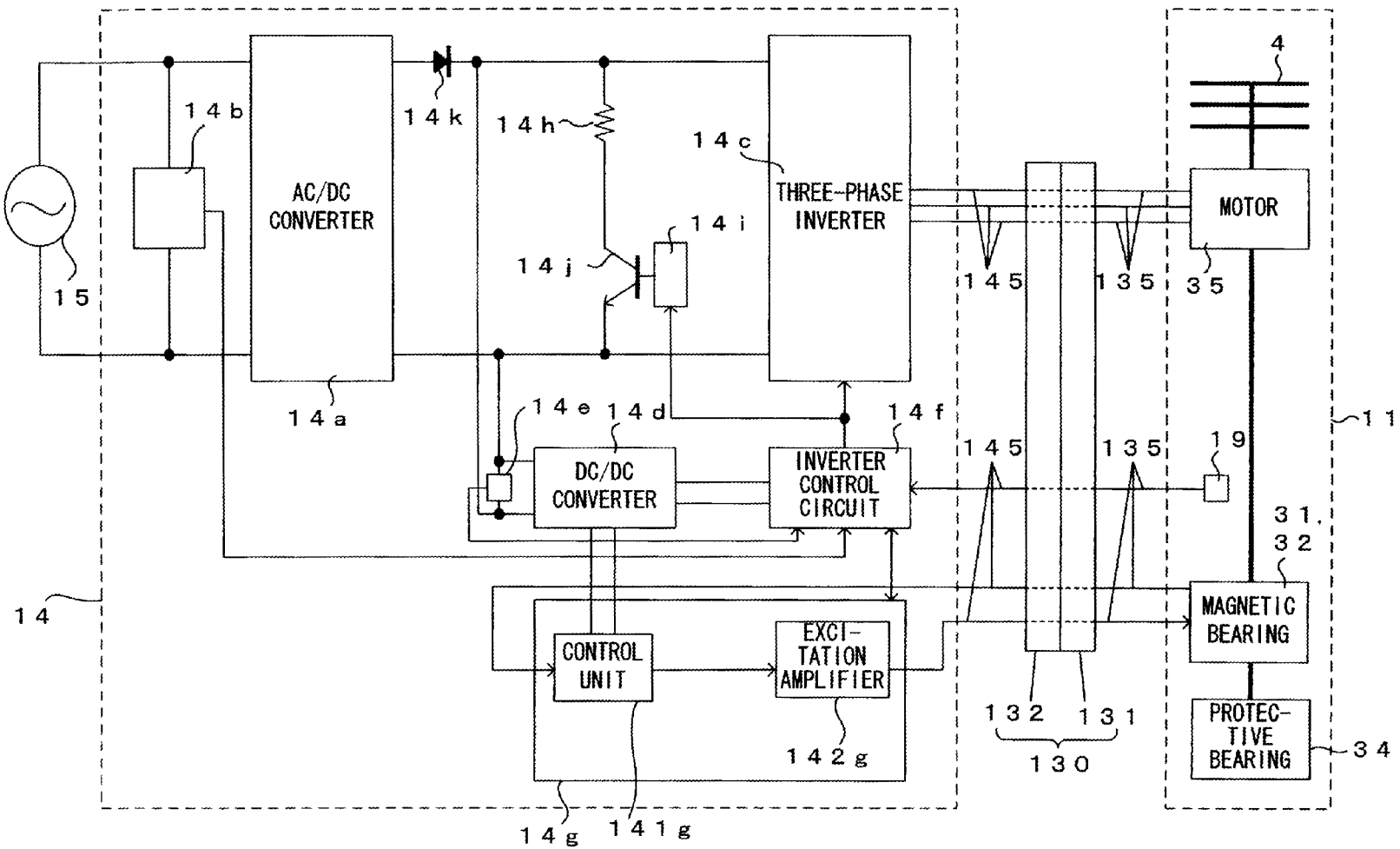
FIG. 9 presents a block diagram illustrating details of the control device.

Referring to FIG. 9, the power source device 14 is explained. The power source device 14 is supplied with alternating current power from a primary power source 15. The alternating current power is input to an AC/DC converter 14*a*. The voltage of the input alternating current power is detected by a voltage sensor 14*b*. The AC/DC converter 14*a* converts the alternating current power supplied by the primary source 15 into direct current power. The direct current power output from the AC/DC converter 14*a* is input into a three-phase inverter 14*c* that drives the motor 35 and a DC/DC converter 14*d*. The voltage of the direct current power input into the DC/DC converter 14*d* is detected by a voltage sensor 14*e*. The output from the DC/DC converter 14*d* is input into an inverter control circuit 14*f* that controls the three-phase inverter 14*c* by PWM (pulse width modulation) control or the like and a magnetic bearing control section 14*g* that performs control of magnetic levitation by the magnetic bearings 31 and 32.

The magnetic bearing 14*g* includes a control unit 141*g* that controls the bearing and an excitation amplifier 142*g* that supplies excitation current to the magnetic bearings 31, 32 based on a control signal calculated by the control unit 141*g*.

The number of rotation of the rotor 4 detected by a rotation number sensor 19 is input to an inverter control circuit 14*f*. The inverter control circuit 14*f* controls the three-phase inverter 14*c* based on the number of rotations of the rotor 4 (hereafter, referred to "rotor rotation number"). A regeneration brake resistor (sheathed heater) 14*h* for the consumption of regeneration surplus power consumes regeneration power that is regenerated when the speed of the rotor is being reduced. A transistor control circuit 14*i* controls on/off of a transistor 14*j* to control on/off of the current that flows through the regeneration brake resistor 14*h*. A diode 14*k* is provided to prevent occurrence of adverse current at the time of regeneration. Description of specific arrangements of elements and substrates in the power source device 14 is omitted here.

A plurality of wires 135 on the pump main body 11 side and a plurality of wires 145 on the power source device 14 side are connected to each other through the connector device 130. The connector device 130 has a pair of connector members 131 and 132 that are detachably attached to each other. One connector member 131, which includes respective terminals of the wires 135, is attached to the mechanical section shutter plate 122 as mentioned above. The other connector member 132 includes respective terminals of the wires 145. The connector member 132 is attached to each end of the wires 145 that is taken out from within the power source device chassis 140 through the opening 13*j* that is provided in the jacket main body 13*a*. When the connectors 131 and 132 are connected to each other, the terminals for the wires 135 and the terminals for the wires 145 are electrically connected to each other.

Conventionally, when the power source device 14 is attached on the lower surface of the pump main body 11 coaxially with the shaft center of the pump (i.e., a center axis of rotation of the rotor 4), the phase of attachment (angular position of attachment) of the power source device 14 centered on the center shaft of the pump with respect to the pump main body 1 cannot be changed freely based on the following reasons. That is, it has been conventionally the case that on the pump main body 11 side, the connector member 131 is directly connected to the casing 120, so that it is difficult to change the position of the connector member 131 with respect to the pump main body 11 after assembly of the pump main body 11. On the power source device 14 side, it becomes necessary to change the design of the substrate. Therefore, it is difficult to change the position of the connector member 132 with respect to the power source device 14 after assembly of the power source device 14. Accordingly, it has been conventionally possible to connect the power source device 14 to the pump main body 11 only when the connector members 131 and 132 are in phases of attachment where the connector members 131 and 132 are on the same angular position.

When it is contemplated to change the layout of the equipment around the turbomolecular pump device 1 based on the convenience of the user of the turbomolecular pump device 1, it is desirable that the orientation of the discharge port 12H and the orientation of the cooling water inlet 13*b* and the cooling water outlet 13*c* can be freely changed. However, in the case of the conventional turbomolecular pump device, the phase of attachment of the power source device 14 centered on the pump shaft center with respect to the pump main body 11 cannot be freely changed as mentioned above.

In the case of the turbomolecular pump device 1 according to the present embodiment, the angular positions of the connector members 131 and 132 are made coincident with each other by changing the phase of attachment of the mechanical section shutter plate 122, to which the connector member 131 is attached, to the casing 120 so as to conform to the phase of attachment (angular position of attachment) of the power source device 14 to the pump main body 11 centered on the pump shaft.

Figure 10A:
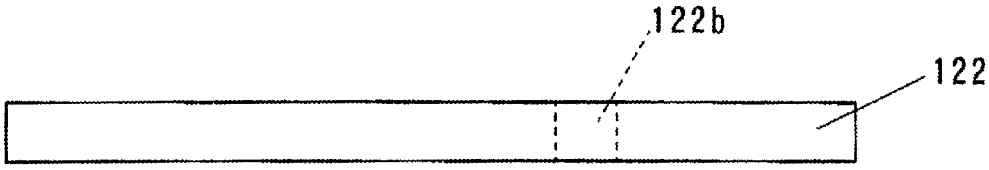
FIG. 10A presents a side view of the single mechanical section shutter plate.
Figure 10B:
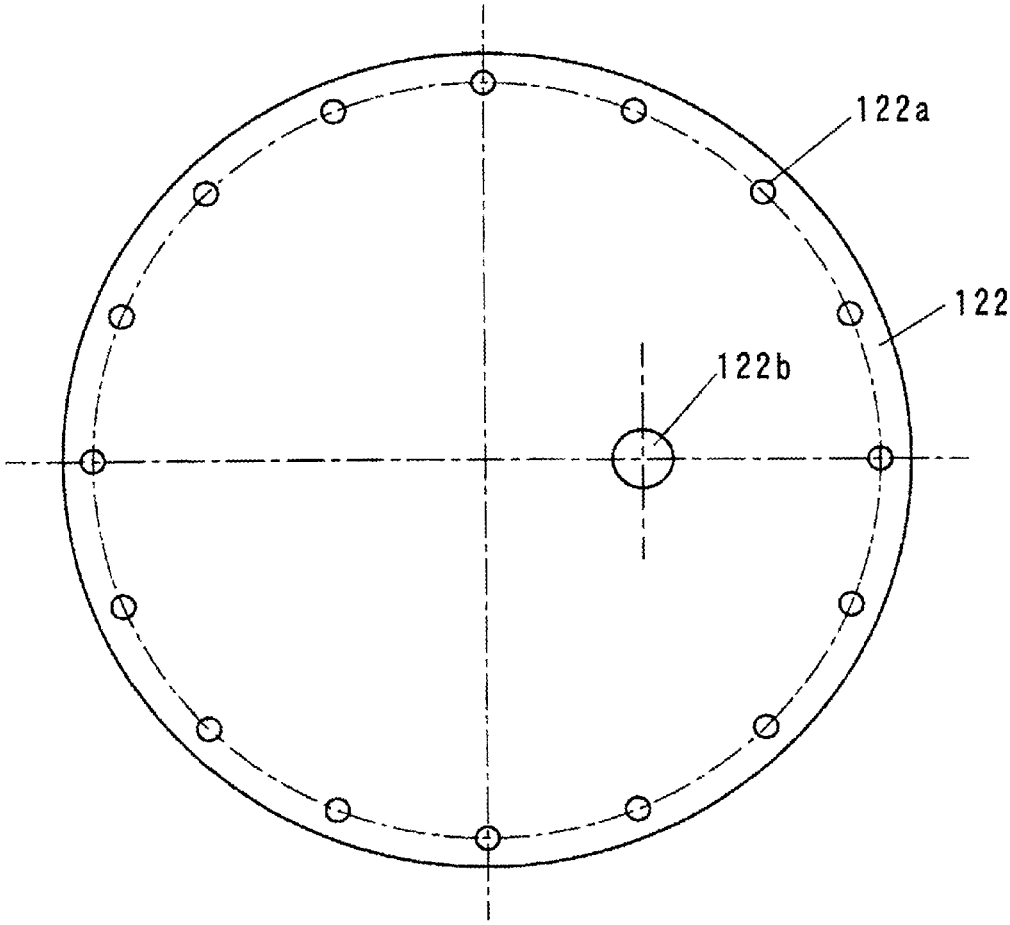
FIG. 10B presents a bottom view of the single mechanical section shutter plate.
Figure 11A:
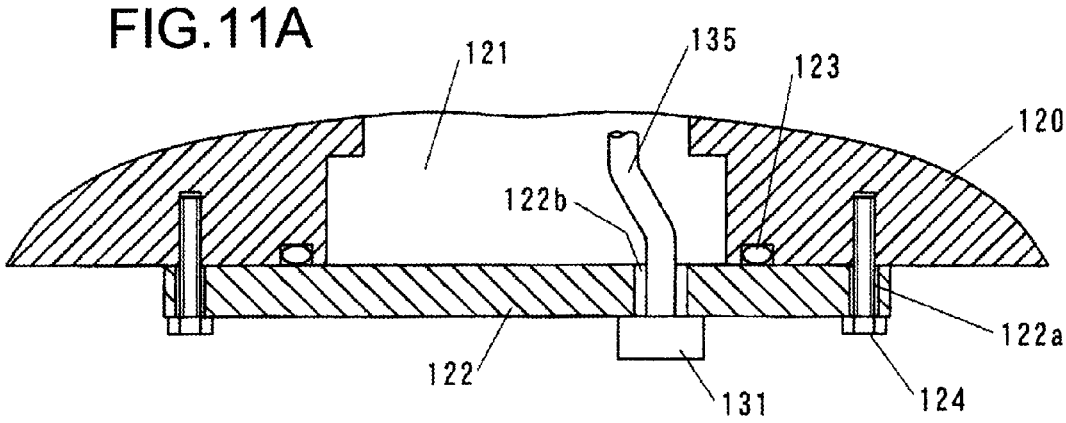
FIG. 11A presents a side view of the mechanical section shutter plate as attached to the lower surface of the casing.
Figure 11B:
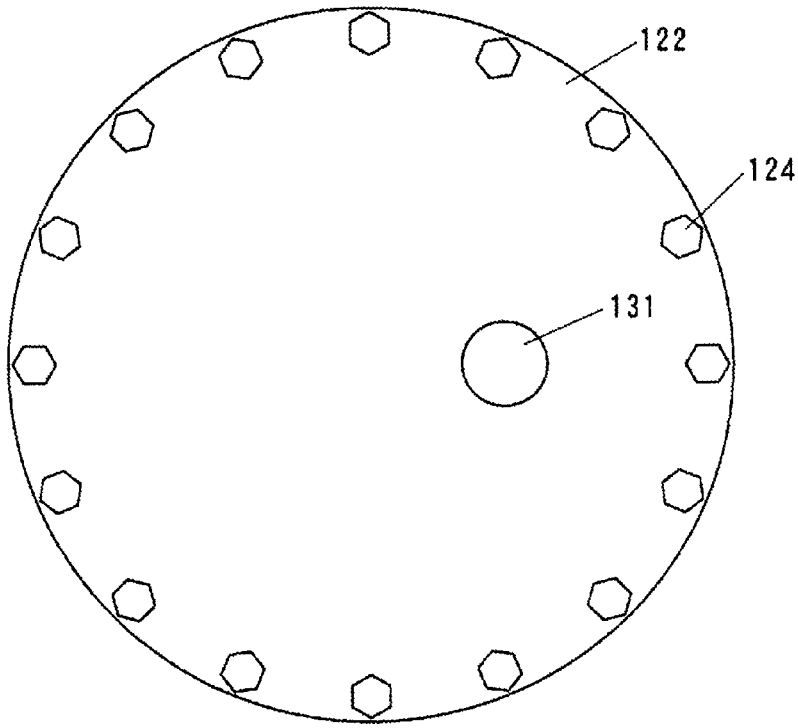
FIG. 11B presents a bottom view of the mechanical section shutter plate as attached to the lower surface of the casing.

FIGS. 10A and 10B show the mechanical section shutter plate 122 alone. FIG. 10A presents a side view of the mechanical section shutter plate 122 alone and FIG. 10B presents a bottom view of the mechanical section shutter plate 122 alone. FIGS. 11A and 11B show the mechanical section shutter plate 122 as attached to the lower surface of the casing 120. FIG. 11A presents a side view of the mechanical section shutter plate 122 and FIG. 11B presents a bottom view of the mechanical section shutter plate 122. The mechanical section shutter plate 122 is provided with bolt holes 122*a* through which bolts 124 are installed for attaching it to the lower surface of the casing 120. The mechanical section shutter plate 122 is also provided with through holes 122*b* through which each wire 135 is inserted.

The bolt holes 122*a* are provided on the circumference of a circle centered on the central position of the mechanical section shutter plate 122 (that is, pump shaft center) in the same angular pitch as the screw holes 13*h* of the cooling device 13. The through-hole 122*b* is provided at a position eccentric from the central position of the mechanical section shutter plate 122. The amount of eccentricity (distance) of the through-hole 122*b* from the central position of the mechanical section shutter plate 122 is substantially equal to the amount of eccentricity of the opening 13*j* of the cooling device 13 from the central position of the depression 13*i*. With this configuration, the mechanical section shutter plate 122 can be attached to the lower surface of the casing 120 at the same angular pitch as that of the screw holes 13*h* of the cooling device 13 in any angular phase. At the same time, the positions of the connector members 131 and 132 are made coincident with each other to enable connection of them with each other.

When the mechanical section shutter plate 122 is attached to the lower surface of the casing 120 with bolts 124, the casing 120 is hermetically closed with respect to the environment by means of O-rings 123.

As mentioned above, according to the present embodiment, the connector member 131 is attached to the mechanical section shutter plate 122 so that the mechanical section shutter plate 122 and the power source device 14 can be attached to the casing 120 at the same angular pitch at any desired angular phase centered on the pump shaft center. As a result, the phase of attachment of the power source device (control unit) 14 to the pump main body 11 centered on the pump shaft center can be changed without difficulty and freely, so that the layout of the equipment around the turbomolecular pump device 1 can be changed without difficulty and the degree of freedom of the layout is increased. Specifically, the orientations of the cooling water inlet 13*b* and cooling water outlet 13*c* of the cooling device 13, orientations of the wires that connect the power source device 14 to the primary power source 15, positions at which communication cables for communication with external equipment are connected to the power source device 14 and so on can be readily changed with respect to the orientation of the discharge port 12H of the pump main body 11.

Even when the phase of attachment of the power source device 14 with respect to the pump main body 11 is changed, adapters or cables that should otherwise be provided as intervening between the pump main body 11 and the power source device 14 become unnecessary. This prevents an increase in cost and also an increase in height of the turbomolecular pump device 1 which would otherwise be caused by such adapters and cables.

VARIATIONS (1) In the above explanation, the angular pitch of the bolt holes 122*a* of the mechanical section shutter plate 122 is substantially the same as the angular pitch of the screw holes 13*h* of the cooling device 13. However, the present invention is not limited to such a configuration. For example, the angular pitch of the bolt holes 122*a* of the mechanical section shutter plate 122 may be two or more integer times the angular pitch of the screw holes 13*h* of the cooling device 13. The angular pitch of the screw holes 13*h* of the cooling device 13 may be two or more integer times the angular pitch of the bolt holes 122*a* of the mechanical section shutter plate 122.

(2) In the above explanation, the fastening of the casing 120 and the cooling device 13 and the fastening of the casing 120 and the mechanical section shutter plate 122 are achieved with bolts, so that the phase of attachment of the power source device 14 with respect to the pump main body 11 can be changed only at a predetermined angular pitch. However, the present invention is not limited to this configuration. The fastening structure that fastens the casing 120 and the cooling device 13 and the fastening structure that fastens the casing 120 and the mechanical section shutter plate 122 may be, for example, a structure with which an ISO ferrule union joints are fastened with clamps to avoid use of the above-mentioned bolts and these structures make it possible to attach the power source device 14 to the pump main body 11 at any desired phase of attachment.

(3) In the above explanation, the opening 13*j* is provided at a position eccentric from the central position of the depression 13*i* and through-hole 122*b* is provided at a position eccentric from the central position of the mechanical section shutter plate 122. However, the present invention is not limited to this configuration. For example, the opening 13*j* may be provided at the central position of the depression 13*i* and the through-hole 122*b* may be provided at the central position of the mechanical section shutter plate 122. In this case, however, in order to connect the connector members 131 and 132 to each other at a proper angular phase, it is necessary to change the phase of attachment of the mechanical section shutter plate 122 to the casing 120 in conformity with the phase of attachment of the power source device 14 with respect to the pump main body 11.

(4) In the above explanation, the turbomolecular pump device has been described as an example of a vacuum pump. However, the present invention is not limited to the turbomolecular pump device but may be applied to a pump having thread groove pump stages, such as, for example, a drag pump.

(5) In the above explanation, the substantially circular depression 13*i* is provided in the center of the upper surface 13US of the jacket main body 13*a* in order to prevent interference with the mechanical section shutter plate 122. However, it is not essential to provide the depression 13*i*.

(6) The embodiments and variations may be combined with each other in any combinations thereof.

The present invention is not limited to the above-mentioned embodiments and variations and includes vacuum pumps having various structures, e.g., those each including a pump main body having a rotor borne by magnetic bearings; a control unit attached to a lower surface of the pump main body coaxially with a pump shaft center of the pump main body for driving and controlling the pump main body; a connector device that inputs/outputs at least one of power and a control signal between the pump main body and the control unit, having a first connector member on the pump main body side and a second connector member on the control unit side, the first and second connector members being detachably attached to each other; and a connector attachment member attached to the lower surface of the pump main body coaxially with the pump shaft center, in which the first connector member is placed, the connector attachment member being attached to the lower surface of the pump main body at a first phase of attachment or a second phase of attachment depending on a phase of attachment of the pump main body and the control unit.

The above described embodiments are examples and various modifications can be made without departing from the scope of the invention.

What is claimed is:

1. A vacuum pump comprising:

a pump main body having a rotor;

a control unit attached to the pump main body, which drives and controls the pump main body;

a connector device including a first connector member on the pump main body side and a second connector member on the control unit side, the first connector member being detachably attached to the second connect member, at least one of power and a control signal being input and output between the pump main body and the control unit when the first connector member is connected to the second connect member; and a connector attachment member attached to the pump main body between the pump main body and the control unit, the first connector member being attached to the connector attachment member, wherein the connector attachment member is attached to the pump main body at a first angular phase of attachment to the pump main body when an angular phase of attachment of the control unit to the pump main body is a first angular phase of attachment so that the first connector member and the second connector member are located so as to allow attachment of the first connector member and the second connector member to each other, and the connector attachment member is attached to the pump main body at a second angular phase of attachment to the pump main body when an angular phase of attachment of the control unit to the pump main body is a second angular phase of attachment so that the first connector member and the second connector member are located so as to allow attachment of the first connector member and the second connector member to each other.

2. A vacuum pump according to claim 1, wherein the first connector member is attached at a position eccentric from the pump shaft center.

3. A vacuum pump according to claim 1, wherein the pump main body is provided with an opening through which the rotor is introduced for being attached to the pump main body, the opening being provided on a surface of the pump main body on which the connector attachment member is provided, and the connector attachment member is attached to the pump main body so as to shut the opening.

4. A vacuum pump according to claim 2, wherein the pump main body is provided with an opening through which the rotor is introduced for being attached to the pump main body, the opening being provided on a surface of the pump main body on which the connector attachment member is provided, and the connector attachment member is attached to the pump main body so as to shut the opening.

5. A vacuum pump according to claim 3, wherein the connector attachment member is a shutter flange-like member that shuts the opening.

6. A vacuum pump comprising:

a pump main body having a rotor;

a control unit attached to the pump main body, which drives and controls the pump main body;

a connector device including a first connector member on the pump main body side and a second connector member on the control unit side, the first connector member being detachably attached to the second connect member, at least one of power and a control signal being input and output between the pump main body and the control unit when the first connector member is connected to the second connect member; and a connector attachment member having a hole attached to the pump main body between the pump main body and the control unit, the first connector member being attached to the connector attachment member, wherein the connector attachment member and the control unit are adapted to change an angular phase of attachment with respect to the pump main body to a plurality of angular positions allowing the connector attachment member to attach to the pump main body at a changed angular phase of attachment corresponding to the changed angular position so as to allow the first connector member to align with the hole below the connector attachment member to shut the hole and to allow the second connector member to attach with the first connector member.

* * * * *